US010679811B2

(12) United States Patent
Riley

(10) Patent No.: US 10,679,811 B2
(45) Date of Patent: Jun. 9, 2020

(54) WIDE OPERATING RANGE RELAY CONTROLLER SYSTEM

(71) Applicant: Littelfuse, Inc., Chicago, IL (US)

(72) Inventor: James Riley, Lakewood, WA (US)

(73) Assignee: Littelfuse, Inc., Chicago, IL (US)

( * ) Notice: Subject to any disclaimer, the term of this patent is extended or adjusted under 35 U.S.C. 154(b) by 331 days.

(21) Appl. No.: 15/701,724

(22) Filed: Sep. 12, 2017

(65) Prior Publication Data

US 2019/0080868 A1 Mar. 14, 2019

(51) Int. Cl.

| | |
|---|---|
| ***H01H 47/02*** | (2006.01) |
| ***H01H 47/22*** | (2006.01) |
| ***H01H 50/14*** | (2006.01) |
| ***H01H 50/54*** | (2006.01) |
| ***H01H 50/64*** | (2006.01) |
| *H01H 50/02* | (2006.01) |
| *H01H 47/00* | (2006.01) |
| *H01H 51/22* | (2006.01) |

(52) U.S. Cl.

CPC ..... *H01H 47/02* (2013.01); *H01H 47/226* (2013.01); *H01H 50/14* (2013.01); *H01H 50/54* (2013.01); *H01H 50/641* (2013.01); *H01H 47/002* (2013.01); *H01H 50/021* (2013.01); *H01H 51/2209* (2013.01)

(58) Field of Classification Search

CPC .... H01F 7/1615; H01H 47/002; H01H 47/02; H01H 47/22; H01H 47/226; H01H 47/32; H01H 49/00; H01H 50/021; H01H 50/14; H01H 50/32; H01H 50/443; H01H 50/54; H01H 50/641; H01H 51/2209; H01H 51/2263

See application file for complete search history.

(56) References Cited

U.S. PATENT DOCUMENTS

| | | | | |
|---|---|---|---|---|
| 5,172,086 | A * | 12/1992 | Fujihisa | H01H 51/2209 335/14 |
| 8,581,682 | B2 * | 11/2013 | Patino | H01H 51/2209 335/229 |
| 9,305,729 | B2 | 4/2016 | Beauregard et al. | |
| 2016/0093456 | A1 | 3/2016 | Dulle et al. | |
| 2016/0189900 | A1 | 6/2016 | Beauregard et al. | |

(Continued)

OTHER PUBLICATIONS

International Search Report and Written Opinion for the International Patent Application No. PCT/US2018/050491, dated Nov. 21, 2018.

*Primary Examiner* — Kevin J Comber
*Assistant Examiner* — Nicolas Bellido

(57) ABSTRACT

Provided herein is an improved bi-stable relay operable with a relay control circuit including a boost converter and an energy storage device, which is used to switch the bi-stable relay. In some embodiments, the bi-stable relay includes a solenoid wound with multiple coil windings. A conductive plate (e.g., a bus bar) may be coupled to a plunger of the solenoid, and is provided with contacts on each end of the conductive plate. The conductive plate is configured to electrically engage and disengage the solenoid upon respective application of power to the solenoid. The control circuit causes the solenoid to remain in an open position when selectively energized by a pulse for moving and retaining the conductive plate of the plunger against the solenoid for allowing wide operating voltage and reduced operating power.

15 Claims, 6 Drawing Sheets

(56) References Cited

U.S. PATENT DOCUMENTS

| | | | | |
|---|---|---|---|---|
| 2016/0314919 | A1 | 10/2016 | Broker et al. | |
| 2017/0279261 | A1* | 9/2017 | Riley | G01R 19/0092 |
| 2017/0302073 | A1* | 10/2017 | Riley | G01R 31/3278 |

* cited by examiner

WIDE OPERATING RANGE RELAY CONTROLLER SYSTEM

FIELD OF THE DISCLOSURE

The disclosure relates generally to the field of circuit protection devices and, more particularly, to a bi-stable solenoid switch with a wide operating range.

BACKGROUND OF THE DISCLOSURE

An electrical relay is a device that enables a connection to be made between two electrodes in order to transmit a current. Some relays include a coil and a magnetic switch. When current flows through the coil, a magnetic field is created proportional to the current flow. At a predetermined point, the magnetic field is sufficiently strong to pull the switch's movable contact from its rest, or de-energized position, to its actuated, or energized position pressed against the switch's stationary contact. When the electrical power applied to the coil drops, the strength of the magnetic field drops, releasing the movable contact and allowing it to return to its original de-energized position. As the contacts of a relay are opened or closed, there is an electrical discharge called arcing, which may cause heating and burning of the contacts and typically results in degradation and eventual destruction of the contacts over time.

A solenoid is a specific type of high-current electromagnetic relay. Solenoid operated switches are widely used to supply power to a load device in response to a relatively low level control current supplied to the solenoid. Solenoids may be used in a variety of applications. For example, solenoids may be used in electric starters for ease and convenience of starting various vehicles, including conventional automobiles, trucks, lawn tractors, larger lawn mowers, and the like.

A normally open relay is a switch that keeps its contacts closed while being supplied with the electric power and that opens its contacts when the power supply is cut off. Currently, most normally open relays have limited operating voltage ranges. For example, normally open relays are limited to operate in either a nominal 12 or 24 volt ranges. Other relays today can operate over a wider voltage range, e.g., between 5 v and 32 v. However, on the low end of the voltage range, a normally open relay may chatter due to a weak magnetic holding force. At the high end of the voltage range, the relay will consume a large amount of energy and produce an excessive amount of heat due to current constantly flowing in the coil windings. This leads to an increased overall size of the relay when compared to a similarly rated bi-stable relay due to the need for the coil windings required to support the constant current.

Thus, a need exists for an improved bi-stable electrical solenoid switch having a constant current source capable of operating in a constant current mode allowing for a wide operating voltage range and a lower operating power. It is with respect to these and other considerations that the present improvements are provided.

SUMMARY OF THE DISCLOSURE

In one approach, according to the present disclosure, a relay controller includes a bi-stable relay having a first terminal and a second terminal, a conductive plate operable with the first and second terminals, and a plunger coupled to conductive plate for actuating the conductive plate relative to the first and second terminals. The relay controller further includes an analog circuit in communication with the bi-stable relay, the analog circuit including a boost converter electrically configured to boost a first voltage supply level to a second voltage supply level, the second voltage supply level higher than the first voltage supply level, an energy storage device electrically coupled with the boost converter, and a closed relay driver circuit and an open relay driver circuit electrically coupled with the boost converter and the energy storage device. The closed relay driver circuit provides a first signal to the bi-stable relay, and wherein the open relay driver circuit provides a second signal to the bi-stable relay.

In another approach, according to the present disclosure, a bi-stable relay control circuit includes a boost converter electrically configured to boost a first voltage supply level to a second voltage supply level, the second voltage supply level higher than the first voltage supply level, and an energy storage device electrically coupled with the boost converter. The bi-stable relay control circuit further includes a closed relay driver circuit and an open relay driver circuit electrically coupled with the boost converter and the energy storage device, wherein the closed relay driver circuit provides a first signal to the bi-stable relay, and wherein the open relay driver circuit provides a second signal to the bi-stable relay.

In yet another approach, a method for controlling a bi-stable relay includes receiving a single active high input at a bi-stable relay control circuit, the bi-stable relay control circuit including a boost converter electrically configured to boost a first voltage supply level to a second voltage supply level, the second voltage supply level higher than the first voltage supply level. The bi-stable relay control circuit further includes an energy storage device electrically coupled with the boost converter, and a closed relay driver circuit and an open relay driver circuit electrically coupled with the boost converter and the energy storage device. The method further includes delivering a pulse to a bi-stable relay in response to the single active high input, wherein the pulse opens or closes a set of contacts of the bi-stable relay.

BRIEF DESCRIPTION OF THE DRAWINGS

The accompanying drawings illustrate exemplary approaches of the disclosed embodiments so far devised for the practical application of the principles thereof, and in which.

Figure 1:
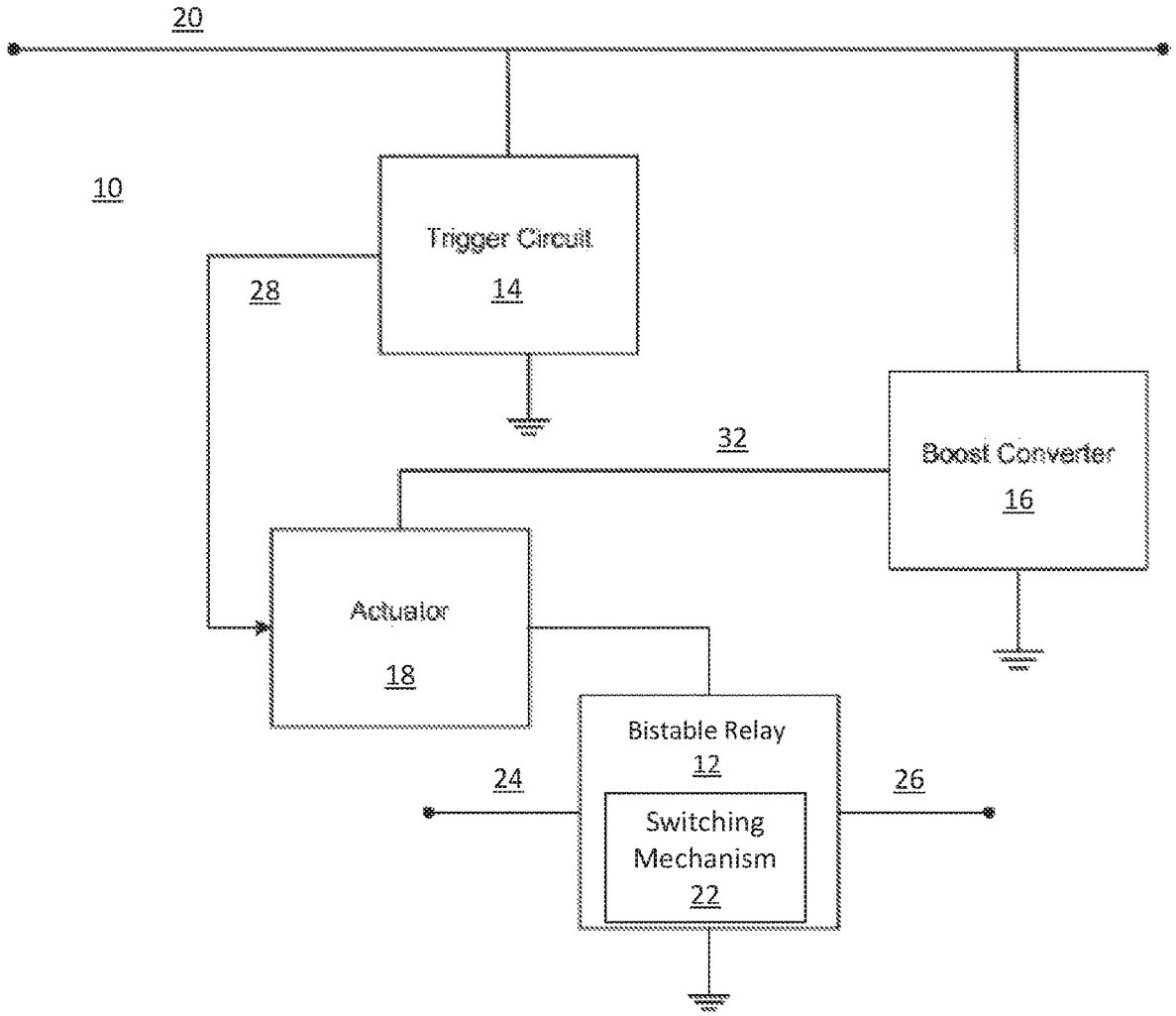
FIG. 1 depicts a block diagram of a system according to embodiments of the present disclosure.

The drawings are not necessarily to scale. The drawings are merely representations, not intended to portray specific parameters of the disclosure. The drawings are intended to depict typical embodiments of the disclosure, and therefore should not be considered as limiting in scope. In the drawings, like numbering represents like elements.

Furthermore, certain elements in some of the figures may be omitted, or illustrated not-to-scale, for illustrative clarity. Furthermore, for clarity, some reference numbers may be omitted in certain drawings.

DETAILED DESCRIPTION

Embodiments in accordance with the present disclosure will now be described more fully hereinafter with reference to the accompanying drawings. The system/circuit may be embodied in many different forms and should not be construed as being limited to the embodiments set forth herein. Rather, these embodiments are provided so that this disclosure will be thorough and complete, and will fully convey the scope of the system and method to those skilled in the art.

For the sake of convenience and clarity, terms such as "top," "bottom," "upper," "lower," "vertical," "horizontal," "lateral," and "longitudinal" will be used herein to describe the relative placement and orientation of various components and their constituent parts. Said terminology will include the words specifically mentioned, derivatives thereof, and words of similar import.

As used herein, an element or operation recited in the singular and proceeded with the word "a" or "an" should be understood as not excluding plural elements or operations, unless such exclusion is explicitly recited. Furthermore, references to "one embodiment" of the present disclosure are not intended to be interpreted as excluding the existence of additional embodiments that also incorporate the recited features.

As will be described herein, embodiments of the present disclosure use analog circuitry to make a bi-stable relay work similar to a normally open (NO) relay from the standpoint of the user. However, the difference between the NO relay and the bi-stable relay is significant in operation. The NO relay acts when current flows through the coil, and a magnetic field is created proportional to the current flow. The bi-stable relay has two rest points and uses the energized magnetic field to move between each position. To close the relay, the magnetic field is north-south, where the north pole is near the top of the solenoid. To open the relay, the magnetic field is reversed and the north pole is near the bottom of the solenoid. Once a plunger of the relay and the bus bar assembly are in the open or closed positions, current stops flowing in the relay. This is how the relay uses significantly less power than a standard NO relay. Current only flows when it is changing state.

The present disclosure is an improvement over existing approaches because unlike current NO relays, the system herein does not act as a constant current source. Instead, the system includes a boost converter to increase the input voltage to work over a wide range, and then a single analog input pulled high to activate the solenoid. When the single input is removed from battery positive, the relay will open due to the circuitry in the bi-stable relay control circuit.

FIG. 1 illustrates a block diagram of a system 10, arranged according to at least some embodiments of the present disclosure. As depicted, the system 10 includes a bi-stable relay 12, a trigger circuit 14, a boost converter 16, and an actuator 18. The system 10 may operate on input power supplied on a first power rail 20. In some examples, a battery (e.g., a 12 volt battery, a 9 volt battery, or the like) supplies the input power. As used herein, the term "input power" generally refers to the power (having a voltage and current level) available on the first power rail 20 from a power supply (not shown). In some examples, the power supply may include a DC power source, an AC power source and a rectifier circuit, a battery, a number of batteries connected together or generally any other DC power source.

The bi-stable relay 12 may be any suitable bi-stable relay, also referred to as a "latching relay." As known, a bi-stable relay is a relay that remains in its last state when power to the relay is shut off. In general, the bi-stable relay 12 includes a switching mechanism 22 to open or close electrical contact between a first terminal 24 and a second terminal 26. In some examples, the bi-stable relay 12 may be formed from a solenoid operating various components to open or close the switching mechanism 22 contacts. As another example, the bi-stable relay 12 may be formed from opposing coils configured to hold the switching mechanism 22 contacts in place while the coils are relaxed.

As yet another example, the bi-stable relay 12 may be formed from a pair of permanent magnets surrounding a ferrous plunger, disposed within the center of the coil with springs positioned to push the plunger out of the coil. During operation, when the coil is energized in one direction the magnetic field pushes the plunger away from the permanent magnets and the springs keep it in the "released" position, which may correspond to either the open or closed position depending on the positioning and connection of the contacts. When the coil is energized in the other direction, the magnetic field pulls the plunger back into range of the permanent magnets, and it is held (e.g., against the spring force) in place by the magnets. In further examples, the coil may include a center-tapped winding, which can be connected to the positive side of the voltage source. As such, each end of the coil corresponds to the open or close winding. In alternative examples, as will be described in greater detail below, the coil may include two separate windings, namely one for the open and one for the close. Although not limited to any particular configuration or design, the bi-stable relay 12 may be a 300A continuous DC single pole-single throw relay with two high current connections for power input and power output with two or three low current connections for power input, signal input, and ground.

The system 10 is then configured to cause the switching mechanism 22 in the bi-stable relay 12 to enter either the open or closed state when a particular condition occurs (e.g., input power on the first power rail 20 is interrupted). As used herein, input power may be interrupted when: the input power falls below a specified value; when the input power falls to zero; when the input power is reduced by a specified percentage; when the input power falls below a specified value for a specified amount of time; or generally whenever there is a reduction or interrupt in the supply of power available on the first power rail 20.

As depicted, the trigger circuit 14 and the actuator 18 are communicatively coupled together via a signal line 28. During operation, the trigger circuit 14 monitors the first power rail 20 to identify a selected condition that indicates an interruption of input power. When the trigger circuit 14 identifies the selected condition, it sends a signal to the actuator 18 over the signal line 28. The actuator 18 is activated by this signal and causes the switching mechanism 22 of the bi-stable relay 12 to enter the "normal" state. Said differently, when activated by the signal from the trigger circuit 14, the actuator 18 supplies the correct electrical pulse (e.g., having sufficient current and duration) to the bi-stable relay 12 to cause switching mechanism 22 to either open or close. As described above, the actuator 18 is configured to cause the bi-stable relay 12 to change state in the absence of input power.

The actuator 18 may be electrically coupled to the boost converter 16 via second power rail 32. As described above, the input voltage (e.g., the voltage level available on the first power rail 20) is increased to a higher level (described in greater detail below), which higher level is used to operate the bi-stable relay 12 and/or charge an energy storage device. The boost converter 16 is then configured to "boost" (i.e., increases) the voltage supplied on the first power rail 20 and make this increased voltage available on the second power rail 32. For example, in some embodiments, the first power rail 20 may be electrically coupled to an input power source configured to supply power having a voltage of 12 Volts. The boost converter 16 may be configured to increase the 12 Volts supplied on the first power rail 20 to 30 Volts, which is made available on the second power rail 32. Many types of boost converters are known. In various embodiments, the boost converter 16 may be formed from analog and/or digital circuit components. For example, a boost converter may be formed from resistors, diodes, capacitors, an inductor, and a DC-DC converter circuit (e.g., DC-DC converter NCP3064, available from ONSEMICONDUCTOR™, or the like).

Figure 2:
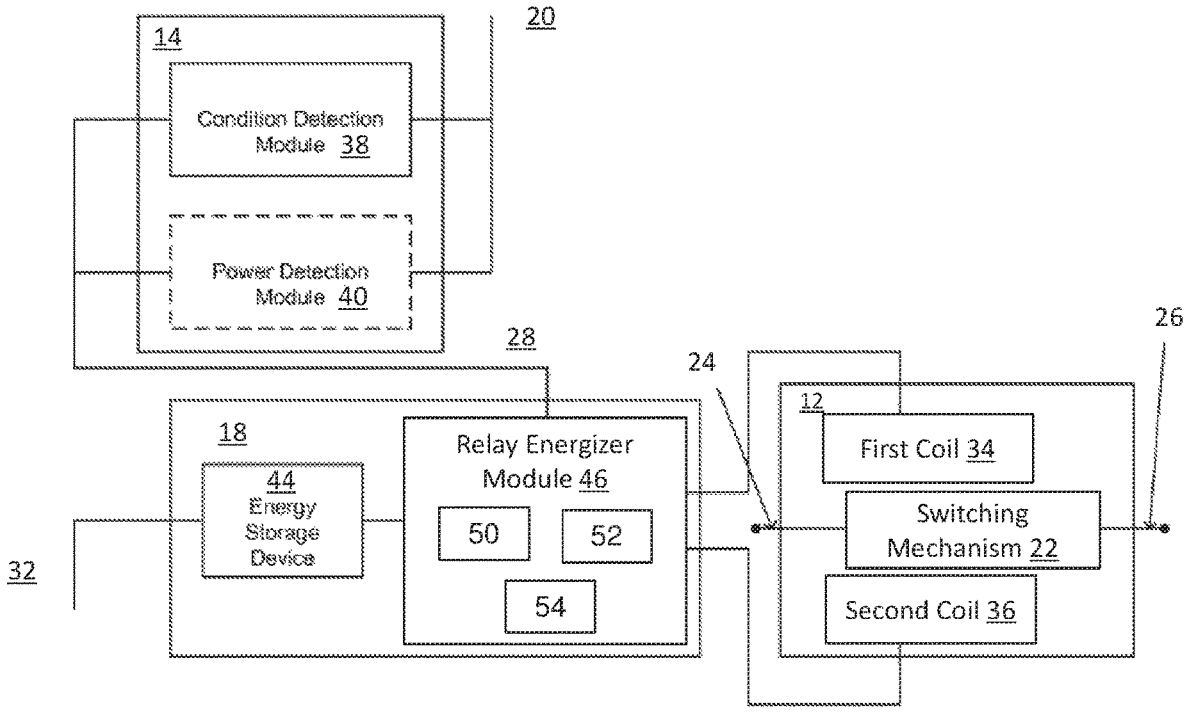
FIG. 2 depicts a block diagram of a portion of the system of FIG. 1 according to embodiments of the present disclosure.

FIG. 2 is a block diagrams of embodiments of portions of the system 10 of FIG. 1. More particularly, FIG. 2 illustrates embodiments of the trigger circuit 14, the actuator 18, and the bi-stable relay 12. It is to be appreciated, that these embodiments (like all embodiments described herein) are given for illustration only and are not intended to be limiting. As depicted, the bi-stable relay 12 is shown including a first coil 34, which may be configured to open the switching mechanism 22, and a second coil 36, which may be configured to close the switching mechanism 22. Accordingly, during operation, energizing either the first or second coils 34, 36 may change the state of the bi-stable relay 12.

The trigger circuit 14 may include a condition detection module 38 and may optionally include a power detection module 40. In some examples, the modules 38 and 40 may be implemented using conventional analog, digital circuit, and/or programmable components. For example, the trigger circuit 14 may be realized from a voltage detection circuit with a fixed width pulse generator. In some examples, a programmable integrated circuit (e.g., microprocessor, or the like) may be used to implement the modules 38 and 40. For example, a microprocessor may be programmed to monitor the first power rail 20 for an interruption in power, and when an interruption in power is detected, the detection module 38 may signal the actuator 18 via the signal line 28, as described above. This may be facilitated by using a microprocessor having a low voltage interrupt feature, wherein the low voltage interrupt is configured to detect a low voltage condition of the first power rail 20 and send a signal (e.g., the interrupt) to the actuator 18 via the signal line 28.

The trigger circuit 14 may optionally be configured to cause the bi-stable relay 12 to enter a known state upon detecting power on the first power rail 20. Said differently, the trigger circuit 14 may be configured to cause the bi-stable relay 12 to enter a known state when the bi-stable relay 12 is initially powered on (or when power is restored after an interruption). The power detection module 40, then, may be configured to monitor the first power rail 20 and detect when power becomes available (e.g., when power raises above a specified level, when power raises above a specified level for a specified amount of time, or the like), sometimes referred to as "the threshold voltage". Upon detecting power on the first power rail 20, the trigger circuit 14 may signal the actuator 18 via the signal line 28 as described above. The power detection module 40 may be implemented using analog, digital, and/or programmable logic components.

In some examples, the trigger circuit 14 may include a comparator to detect the threshold voltage, which may then trigger a one-shot circuit to pulse the actuator 18 for the correct amount of time. With some examples, an analog comparator on-board a microcontroller chip can be used to detect the threshold voltage while a timer can be used to control the pulse width. Some examples may include a brownout voltage detector operably connected to a comparator to generate an interrupt to a microcontroller.

In some examples, the trigger circuit 14 may also monitor the voltage output from the boost converter 16 to ensure that there is enough energy stored in an energy storage device 44 (e.g., a capacitor) to actuate the bi-stable relay 12. With some examples, the trigger circuit 14 may be configured to not close (or open) the bi-stable relay 12 until there is enough energy stored in the energy storage device 44 to trigger the open (or close) event.

The actuator 18 may include an energy storage device 44 and a relay energizer module 46. In general, the relay energizer module 46 is configured to supply a sufficient energy pulse to the coils 34, 36 to cause the bi-stable relay 100 to change state. More particularly, the relay energizer module 46 may be configured to energize either the coil 34 or the coil 36 (depending upon whether the bi-stable relay 12 is being opened or closed) upon being signaled by the condition detection module 38. The relay energizer module 46 may be implemented using analog, digital, and/or programmable logic components. For example, the relay energizer module 46 may be implemented using a combination of resistors, diodes, mini-relays, BJT, IGBT, and/or MOSFET logic components. More specifically, as will be described in further detail below, the relay energizer module 46 may include an open relay driver circuit 50 and a closed relay driver circuit 52 electrically coupled with the energy storage device 44 and the boost converter 16 via a 3-jack connector 54.

In order to supply a sufficient energy pulse to the coils 34 and 36, particularly, in the absence of input power on the first power rail 20, the actuator 18 includes the energy storage device 44. In general, the energy storage device 44 may be any device capable of storing energy (e.g., a capacitor, rechargeable battery, or the like). The energy storage device 44 is then charged to the nominal voltage level available on the second power rail 32 (i.e., the boosted input voltage level). Subsequently, when the input power is interrupted, the energy stored in the energy storage device 44 is used to energize either of the coils 34 or 36. As will be appreciated, the energy stored in a capacitor may be represented by the following equation: $E=\frac{1}{2}*C*V^2$, where E is the energy in the capacitor, C is the capacitance of the capacitor, and V is the voltage to which the capacitor is charged.

In a particularly illustrative example, the first power rail 20 may be supplied by a power source having a voltage level of 12 Volts. The boost converter 16 may boost the 12 Volts to 30 Volts, which is available on the second power rail 32. The energy storage device 44 may be a capacitor having a capacitance of 2000 uFarads. Accordingly, charging the capacitor to 30 volts will result in a stored energy value of 0.9 Joules (i.e., $0.5*0.002*30^2$). Achieving an equivalent energy value from the input voltage (i.e., 12 Volts) would require a much larger capacitor (e.g., having a capacitance of greater than 13,750 uFarads). As will be appreciated, the ability to use a smaller capacitor (e.g., due to the functionality of the boost converter 16) enables the use of a smaller capacitor, which reduces cost, size, and operational delay for the system 10 as compared to conventional devices.

Figure 3:
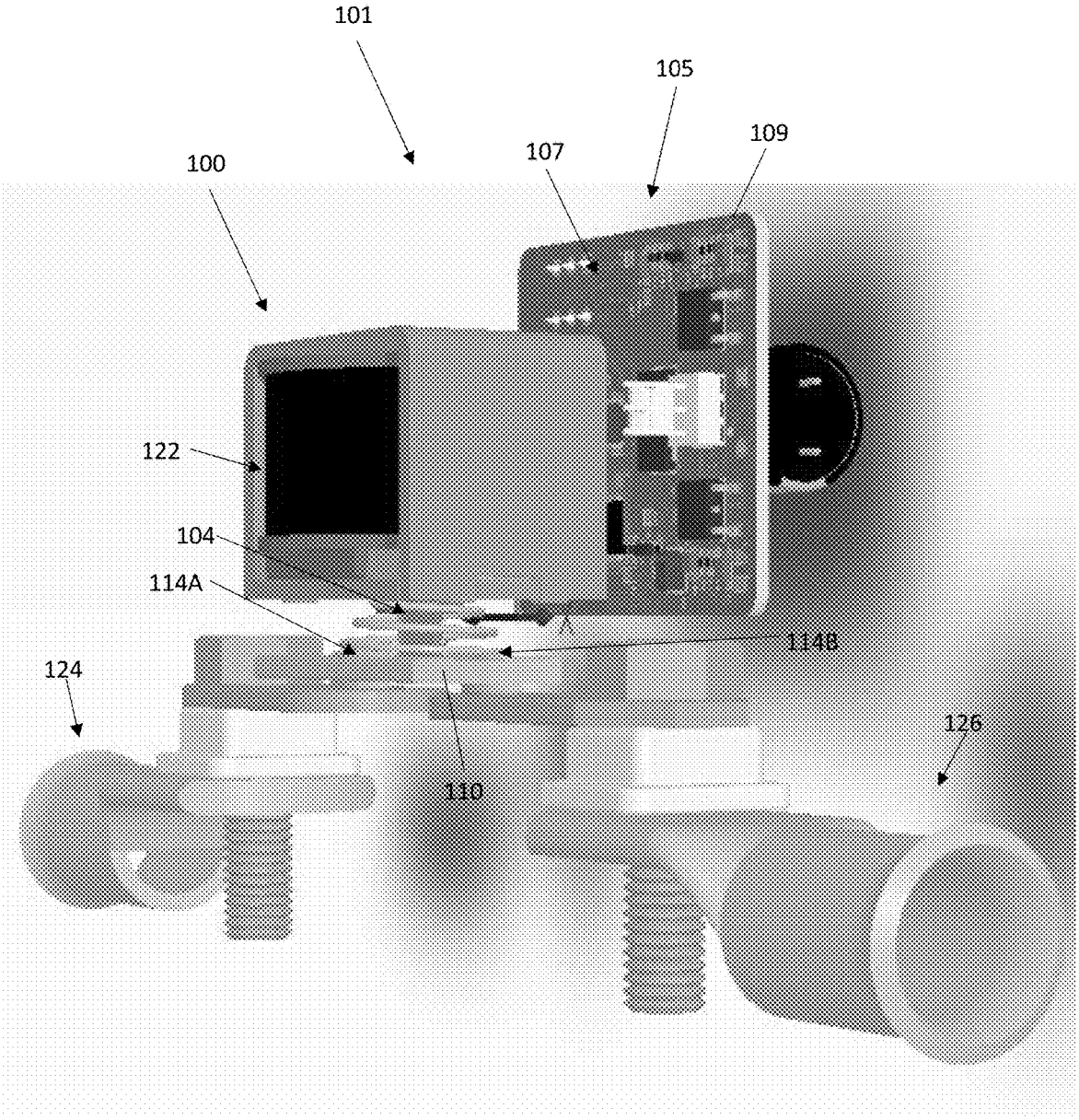
FIG. 3 depicts a perspective view of a system including a bi-stable relay and a control circuit according to embodiments of the present disclosure.
Figure 4:
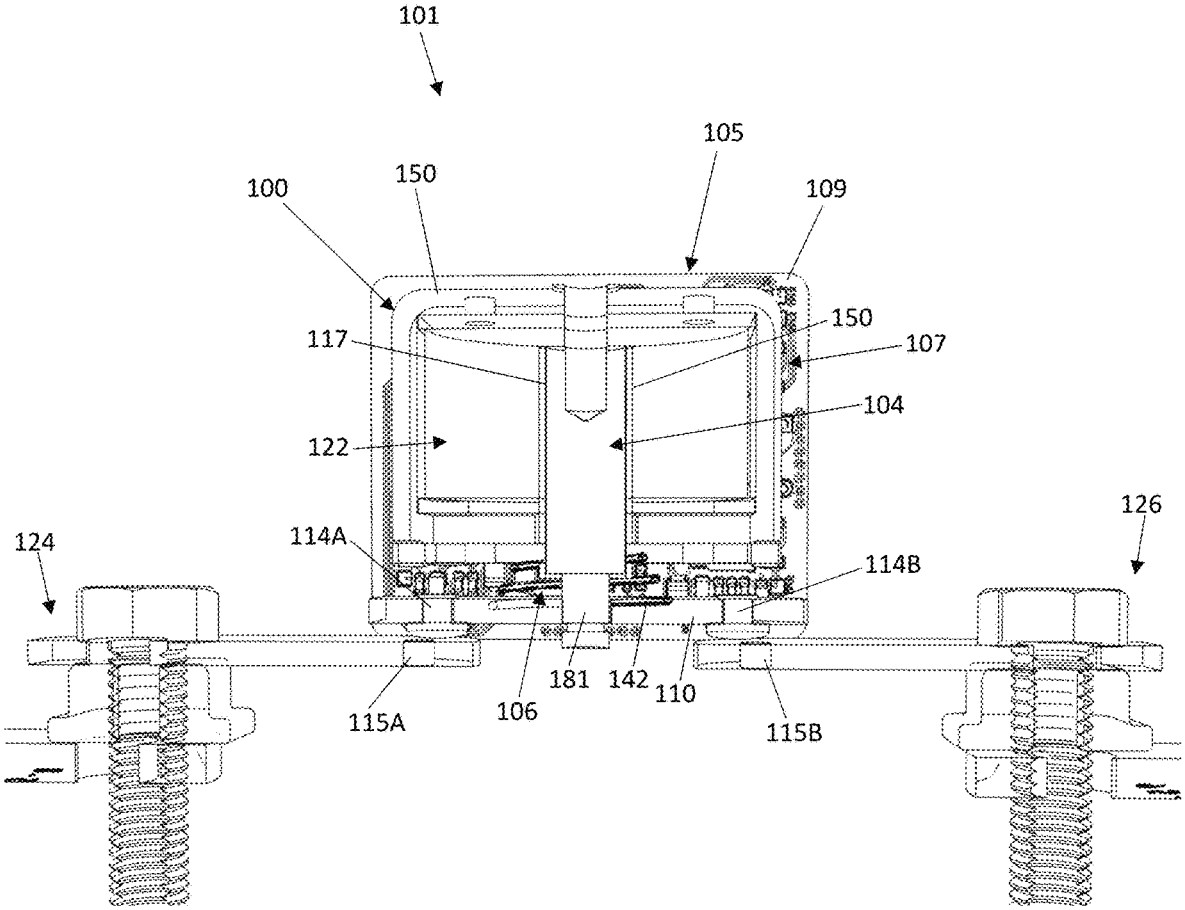
FIG. 4 depicts a side cross-sectional view of the bi-stable relay of FIG. 3 according to embodiments of the present disclosure.

Turning now to FIGS. 3-4, a system 101 including a wide operating range relay controller (hereinafter "controller") 105 according to embodiments of the disclosure will be described in greater detail. The system 101 includes an exemplary bi-stable relay, which may be an electrical solenoid switch 100, connected to an analog circuit in accordance with the present disclosure. More specifically, the controller 105, which may include a bi-stable relay control circuit (hereinafter "control circuit") 107 assembled on a printed circuit board 109, is configured to receive the electrical solenoid switch 100 to provide electrical connection between the electrical solenoid switch 100, a power source, and other circuitry. Although not shown in detail, the control circuit 107 may include the above described trigger circuit, boost converter, and actuator. An electrical connection is provided for providing power to the electrical solenoid switch 100. For example, the coil windings 122 may be connected to the controller 105.

A pair of electrical contacts, such as, for example the electric contacts 114A-B and 115A-B, is immovably mounted on each end of a bus bar 110, which may be a conductive plate. When selectively energized, the electric contacts 114A-B mutually touch the solenoid conductive contacts, such as the electric contacts 115A-B, in a first position (closed, as shown), which forms a closed circuit with the first terminal 124 and the second terminal 126. When selectively de-energized by loss of power, the electric contacts 114A-B and the electric contacts 115A-B are mutually separated in a second position (open), with means for keeping the contacts in the first and in the second positions. Thus, a magnetic coupling member 106 may assist the actuator or plunger 104 to reduce the force necessary by the coil windings 122 to hold the electrical solenoid switch 100 open and operate the coil windings 122 in a constant current mode to allow multi-stage peak-and-hold current that allows wide operating voltage and lower operating power.

For example, the behavior of the electrical solenoid switch 100 may be explained as follows. As the electromagnetic coil windings 122 are connected to the controller 105, the plunger 104, which has been held in an uppermost position (a first, open position) by the actions of a first spring 142, which may be a coiled spring, will be forced to move downwardly within a central aperture 175. The downward movement is a result of a magnetic force generated within the coil windings 122, which have been energized from a constant current mode operation. Because the plunger 104 is magnetically attracted to the magnetic coupling member 106, the magnetic coupling member 106 reduces the overall amount of the magnetic force necessary for creating the downward movement of the plunger 104 and retaining the plunger 104 in this closed position. In the closed position, the electric contacts 114A-B mutually touch the solenoid conductive contacts, such as the electric contacts 115A-B, in the first position, such as a closed or "powered on" position.

Then, as the supply of the constant current to the coil windings 122 are suspended, the plunger 104 will be forced to return to its initial position (a first position) by the restoring forces of the first spring 142 applied to the plunger 104 while simultaneously overcoming the magnetic attraction of the plunger 104 to the magnetic coupling member 106. The electric contacts 114A-B disengaged from the solenoid conductive contacts, such as the electric contacts 115A-B, in the second position, such as an open or "powered off" position when the plunger 104 is forced to return to its initial position (a first position) by the restoring forces of the first spring 142 applied to the plunger 104.

More specifically, in some embodiments, the electrical solenoid switch 100, such as, for example, a bi-stable electrical solenoid switch, may include a solenoid bobbin 116 (e.g., a solenoid bobbin housing). The solenoid bobbin 116 is formed within a solenoid body 150 with coil windings 122 wound around the solenoid bobbin 116. The solenoid bobbin 116 has a body or connection piece 117. The connection piece 117 may be defined in one of multiple geometric configurations. For example, the connection piece 117 may be a circular pipe shaped having a predetermined thickness and predetermined diameter. The solenoid body 150, or more specifically the solenoid bobbin 116, includes the central aperture 175 defined therein, and the coil windings 122, which when engaged by a power source, generate a magnetic field.

As shown, the plunger 104 is at least partially disposed in the central aperture 175 for rotation and axial reciprocation between at least two positions into and out of the central aperture 175 relative to the solenoid body 150 and the magnetic coupling member 106. A portion of the plunger 104 is at least partially disposed in the central aperture 175, while a lower neck section 181 of the plunger is coupled to the conductive plate 110 (e.g., an input conductive plate), such as a movable bus bar. The plunger 104 is magnetically attracted towards the magnetic coupling member 106.

The conductive plate 110 is coupled to the plunger 104 and provided with one or more electric contacts 114A on opposite ends of the conductive plate 110. In one embodiment, the electric contacts 114A-B (e.g., electrical contacts) are silver alloy contacts. The conductive plate 110 may be configured to electrically engage and disengage the solenoid body 150 upon respective application of power to the solenoid body 150. In one embodiment, the electrical contacts 115A-B are configured for electrically engaging and disengaging the electric contacts 114A-B for opening (powered off) and closing (powered on) the electrical solenoid switch 100.

The magnetic field latches and unlatches the plunger 104 between the at least two positions, such as an open position (powered off) and a closed position (powered on) of the electrical solenoid switch 100. The magnetic coupling member 106 is configured to reduce the force necessary by the magnetic field for allowing the solenoid body 150 to remain in an open position when selectively energized for operating in a constant current mode for allowing a wide operating voltage and reduced operating power. The magnetic coupling member 106 retains the plunger 104 in one of the at least two positions. The constant current mode allows for a multi-stage peak-an-hold current. The wide operating voltage is within a range of 5 to 32 volts.

The conductive plate 110, coil windings 102, the electric contacts 114A-B and 115A-B, and the plunger 104 may be formed of any suitable, electrically conductive material, such as copper or tin, and may be formed as a wire, a ribbon, a metal link, a spiral wound wire, a film, an electrically conductive core deposited on a substrate, or any other suitable structure or configuration for providing a circuit interrupt. The conductive materials may be decided based on fusing characteristic and durability. In one embodiment, the plunger is a steel material and may include stainless steel caps covering the electric contacts 114A-B and the electric contacts 114A-B and/or may be positioned on each end of the conductive plate 110. The electric contacts 114A-B and the electric contacts 114A-B may also be stainless steel.

Figure 5:
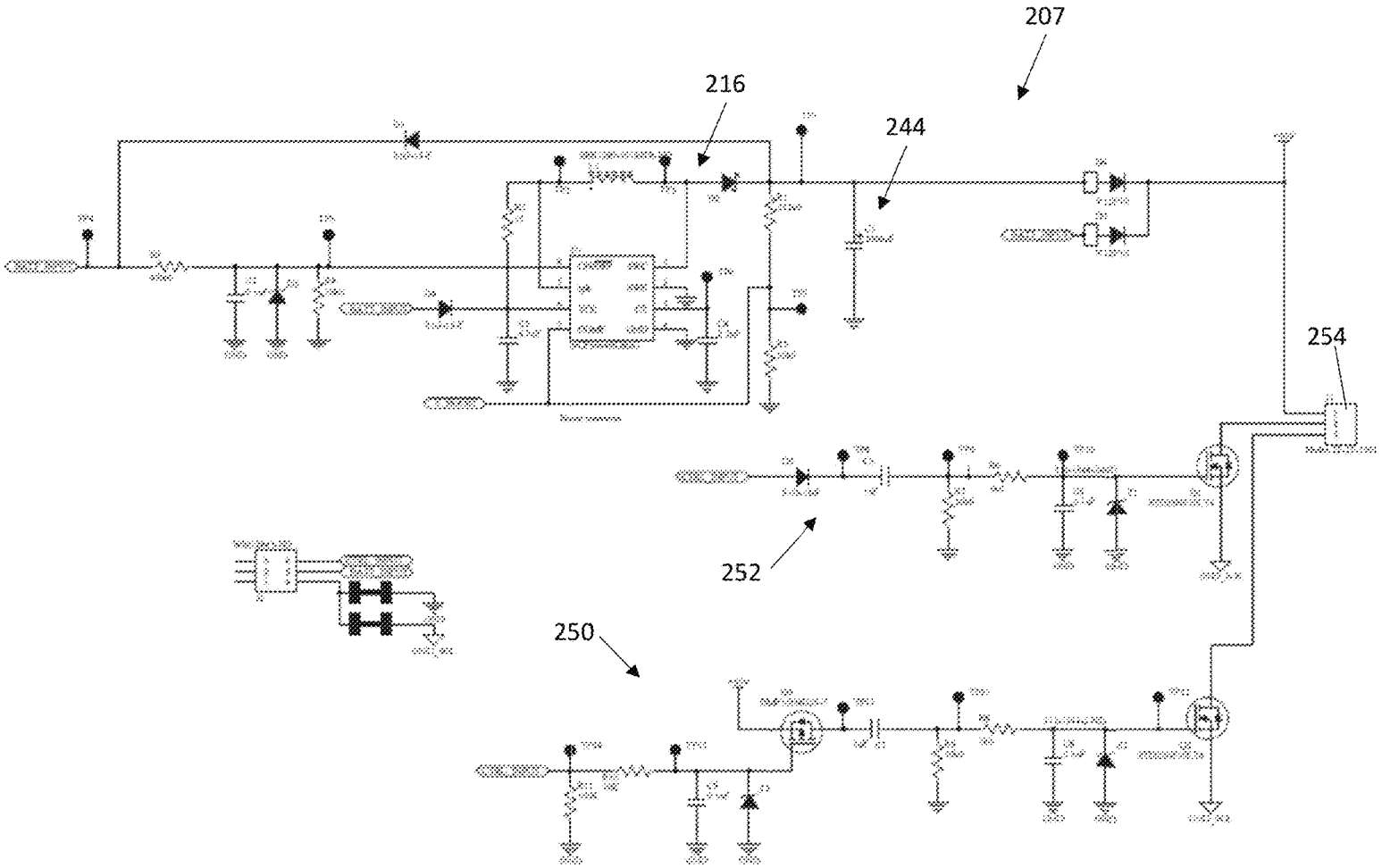
FIG. 5 depicts a circuit diagram of a control circuit according to embodiments of the present disclosure.

Turning now to FIG. 5, a bi-stable relay control circuit 207 according to embodiments of the disclosure will be described in greater detail. As shown, the bi-stable relay control circuit 207 may be an analog circuit formed on a PCB in communication with a bi-stable relay. The bi-stable relay control circuit 207 includes the boost converter 216 to store energy in a capacitor 244, which is used to switch the bi-stable relay. For example, the boost converter 216 and the capacitor 244 may operate the switching mechanism 22 of the bi-stable relay 10 shown in FIGS. 1-2. In the embodiment shown, the boost converter 216 is connected in series with the capacitor 244, which is further connected to a 3-jack connector 254.

The bi-stable relay control circuit 207 further includes an open relay driver circuit 250 and a closed relay driver circuit 252 electrically coupled with the energy storage device 244 and the boost converter 216. The four devices connect to the bi-stable relay via the 3-jack connector 254. During use, the user may have a single active high input. When connected to the battery positive terminal, a pulse will be generated from the analog circuitry to generate a pulse through the windings of the bi-stable relay (e.g., the bi-stable relay 10 or the electrical solenoid switch 100 described above), which will generate a strong enough magnetic field to force the plunger 104 and bus bar 110 of the bi-stable relay into the closed position. When the single active high input is removed from the battery positive terminal, a second pulse will be generated through the secondary winding (e.g., second coil 36) of the bi-stable relay to open the terminals 24, 26. The analog circuitry (e.g., the open relay driver circuit 250 or the closed relay driver circuit 252) of the bi-stable relay control circuit 207 generates the proper pulse width for each solenoid winding, allowing the signal input to be latched in the same manner as a traditional normally open relay, but with the low continuous current consumption of a bi-stable relay.

Figure 6:
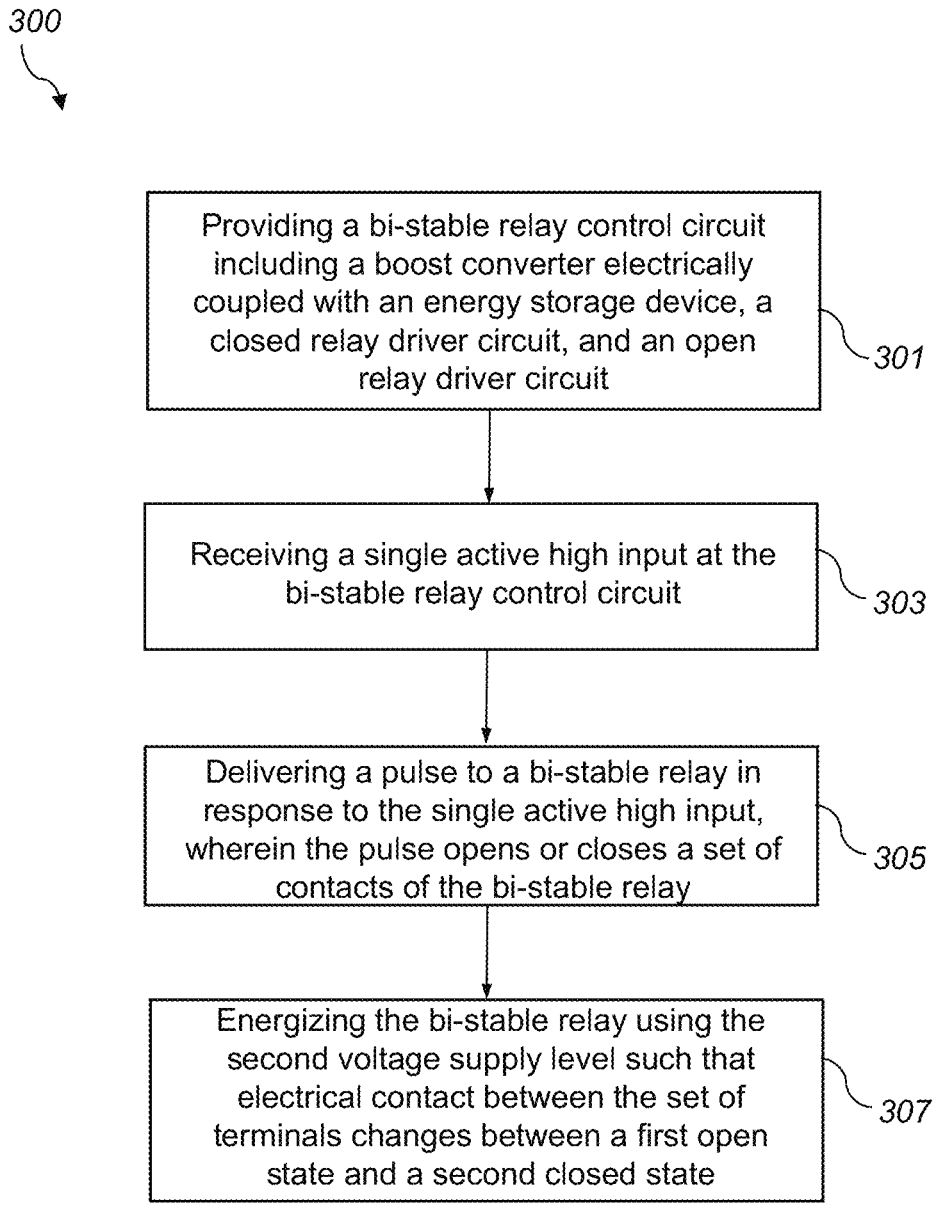
FIG. 6 depicts a flow chart of a method for controlling a bi-stable relay according to embodiments of the disclosure.

Turning now to FIG. 6, a method 300 for controlling a bi-stable relay according to embodiments of the disclosure will be described in greater detail. At block 301, the method 300 may include providing a bi-stable relay control circuit including a boost converter electrically coupled with an energy storage device, a closed relay driver circuit, and an open relay driver circuit. In some embodiments, the closed relay driver circuit, the open relay driver circuit, the boost converter, and the energy storage device are coupled together using a connector. In some embodiments, the energy storage device is a capacitor coupled in series with the boost converter.

At block 303, the method 300 may include receiving a single active high input at a bi-stable relay control circuit.

At block 305, the method 300 may further include delivering a pulse to a bi-stable relay in response to the single active high input, wherein the pulse opens or closes a set of contacts of the bi-stable relay. In some embodiments, block 305 includes delivering a first pulse to a first winding of the bi-stable relay to close the set of contacts, and delivering a second pulse to a second winding of the bi-stable relay to open the set of contacts.

At block 307, the method 300 may include energizing the bi-stable relay using the second voltage supply level such that electrical contact between the set of terminals changes between a first open state and a second closed state.

In sum, at least the following technical advantages are achieved by embodiments of the present disclosure. Firstly, chatter due to a weak magnetic holding force is reduced because the pulse generate through the windings of the bi-stable relay will generate a strong enough magnetic field to force the plunger and bus bar of the relay into the closed position. Secondly, at the high end of the voltage range, the relay does not consume a large amount of energy and/or produce an excessive amount of heat due to current constantly flowing in the coil windings. Instead, the bi-stable relay control circuit generates the proper pulse width for each solenoid winding, allowing the signal input to be latched in the same manner as a traditional normally open relay, but with the low continuous current consumption of a bi-stable relay.

While the present disclosure has been described with reference to certain approaches, numerous modifications, alterations and changes to the described approaches are possible without departing from the sphere and scope of the present disclosure, as defined in the appended claims. Accordingly, it is intended that the present disclosure not be limited to the described approaches, but that it has the full scope defined by the language of the following claims, and equivalents thereof. While the disclosure has been described with reference to certain approaches, numerous modifications, alterations and changes to the described approaches are possible without departing from the spirit and scope of the disclosure, as defined in the appended claims. Accordingly, it is intended that the present disclosure not be limited to the described approaches, but that it has the full scope defined by the language of the following claims, and equivalents thereof.

The invention claimed is:

1. A relay controller system comprising:

a bi-stable relay comprising:

a first terminal and a second terminal;

a conductive plate operable with the first and second terminals; and a plunger coupled to the conductive plate for actuating the conductive plate relative to the first and second terminals; and a control circuit in communication with the bi-stable relay, the control circuit including:

a boost converter electrically configured to boost a first voltage supply level to a second voltage supply level, the second voltage supply level higher than the first voltage supply level;

an energy storage device electrically coupled with the boost converter;

a closed relay driver circuit and an open relay driver circuit electrically coupled with the boost converter and the energy storage device, wherein the closed relay driver circuit provides a first signal to the bi-stable relay, and wherein the open relay driver circuit provides a second signal to the bi-stable relay; and a relay energizer module coupled with the energy storage device, wherein the energy storage device stores a quantity of energy based at least in part on the second voltage supply level, and wherein the relay energizer module energizes the bi-stable relay using the quantity of energy stored in the energy storage device, the relay energizer module comprising:

the closed relay driver circuit and the open relay driver circuit; and a connector coupling together the closed relay driver circuit, the open relay driver circuit, the boost converter, and the energy storage device.

2. The relay controller system of claim 1, further comprising a trigger circuit electrically coupled with the energy storage device and the boost converter, the trigger circuit configured to detect a condition on a first power rail, the first power rail having the first voltage supply level.

3. The relay controller system of claim 1, wherein the closed relay driver circuit is configured to energize the bi-stable relay using the second voltage supply level such that electrical contact between the first terminal and the second terminal changes between a first open state and a second closed state.

4. The relay controller system of claim 1, wherein the bi-stable relay comprises:

a first coil and a second coil; and a switching mechanism operable with the first and second coils, the switching mechanism configured to open or close electrical contact between the first terminal and the second terminal.

5. The relay controller system of claim 4, wherein the control circuit comprises a single active high input causing the closed relay driver circuit to provide the first signal to the first coil, and to provide the second signal to the second coil.

6. The relay controller system of claim 1, wherein the energy storage device is a capacitor electrically connected in series with the boost converter.

7. The relay controller system of claim 1, further comprising a printed circuit board, wherein the control circuit is arranged on the printed circuit board.

8. A bi-stable relay control circuit, comprising:

a boost converter electrically configured to boost a first voltage supply level to a second voltage supply level, the second voltage supply level higher than the first voltage supply level;

an energy storage device electrically coupled with the boost converter;

a closed relay driver circuit and an open relay driver circuit electrically coupled with the boost converter and the energy storage device, wherein the closed relay driver circuit provides a first signal to a bi-stable relay, and wherein the open relay driver circuit provides a second signal to the bi-stable relay; and a relay energizer module coupled with the energy storage device, wherein the energy storage device stores a quantity of energy based at least in part on the second voltage supply level, and wherein the relay energizer module energizes the bi-stable relay using the quantity of energy stored in the energy storage device, the relay energizer module comprising:

the closed relay driver circuit and the open relay driver circuit; and a connector coupling together the closed relay driver circuit, the open relay driver circuit, the boost converter, and the energy storage device.

9. The bi-stable relay control circuit of claim 8, further comprising a trigger circuit electrically coupled with the energy storage device and the boost converter, the trigger circuit configured to detect a condition on a first power rail, the first power rail having the first voltage supply level.

10. The bi-stable relay control circuit of claim 8, wherein the closed relay driver circuit is configured to energize the bi-stable relay using the second voltage supply level such that electrical contact between a first terminal and a second terminal changes between a first open state and a second closed state.

11. The bi-stable relay control circuit of claim 8, further comprising a single active high input causing the closed relay driver circuit to provide the first signal to a first coil of the bi-stable relay, and to provide the second signal to a second coil of the bi-stable relay.

12. The bi-stable relay control circuit of claim 8, wherein the energy storage device is a capacitor electrically connected in series with the boost converter.

13. A method for controlling a bi-stable relay, the method comprising:

receiving a single active high input at a bi-stable relay control circuit, the bi-stable relay control circuit comprising:

a boost converter electrically configured to boost a first voltage supply level to a second voltage supply level, the second voltage supply level higher than the first voltage supply level;

an energy storage device electrically coupled with the boost converter;

a closed relay driver circuit and an open relay driver circuit electrically coupled with the boost converter and the energy storage device;

delivering a pulse to the bi-stable relay in response to the single active high input, wherein the pulse opens or closes a set of contacts of the bi-stable relay; and a relay energizer module coupled with the energy storage device, wherein the energy storage device stores a quantity of energy based at least in part on the second voltage supply level, and wherein the relay energizer module energizes the bi-stable relay using the quantity of energy stored in the energy storage device, the relay energizer module comprising:

the closed relay driver circuit and the open relay driver circuit; and a connector coupling together the closed relay driver circuit, the open relay driver circuit, the boost converter, and the energy storage device.

14. The method according to claim 13, further comprising delivering a first pulse to a first winding of the bi-stable relay to close the set of contacts, and delivering a second pulse to a second winding of the bi-stable relay to open the set of contacts.

15. The method according to claim 13, further comprising energizing the bi-stable relay using the second voltage supply level such that electrical contact between the set of contacts changes between a first open state and a second closed state.

* * * * *